United States Patent [19]

Ricci et al.

[11] Patent Number: 4,835,655

[45] Date of Patent: May 30, 1989

[54] POWER RECOVERY CIRCUIT

[75] Inventors: Raffaele Ricci, Pregnana Milanese; Gabriele Rotondi, Cerro Maggiore, both of Italy

[73] Assignee: Bull HN Information Systems Italia S.p.A., Milan, Italy

[21] Appl. No.: 194,796

[22] Filed: May 17, 1988

[30] Foreign Application Priority Data

Jul. 14, 1987 [IT] Italy ..... 21285 A/87

[51] Int. Cl.[4] ..... H01H 47/00; H01H 47/32; B41J 9/00

[52] U.S. Cl. ..... 361/159; 361/156; 400/157.2

[58] Field of Search ..... 361/18, 156, 159; 307/104; 101/93.29; 400/157.2

[56] References Cited

U.S. PATENT DOCUMENTS

| | | | |
|---|---|---|---|
| 4,336,587 | 6/1982 | Boettcher et al. | 363/134 |
| 4,637,742 | 1/1987 | Sakai | 400/121 |
| 4,661,882 | 4/1987 | Presley | 361/159 |

*Primary Examiner*—A. D. Pellinen
*Assistant Examiner*—David A. Osborn
*Attorney, Agent, or Firm*—George Grayson; John S. Solakian; Lewis P. Elbinger

[57] ABSTRACT

Power recovery circuit for printer haivng printing elements actuated by electromagnets energized by a voltage VS available at a terminal. The circuit includes a voltage booster for generating a voltage HV higher than voltage VS at a node and a buffer capacitor charged by the voltage HV and connected between the terminal and the node, a connection between the electromagnets and the node for transferring the magnetic energy imparted to the electromagnets by the buffer capacitor for storing therein as capacitive energy, an inductor and a control switch, series connected between the node and the terminal, a recirculation diode connected between ground and the node common to the switch and the inductor, a voltage detector providing an enabling signal when voltage HV exceeds a predetermined level and a controlled oscillator, enabled by the enabling signal to generate a control signal which periodically switches the control switch on and off.

4 Claims, 2 Drawing Sheets

POWER RECOVERY CIRCUIT

BACKGROUND OF THE INVENTION

1. Scope of the Invention

The present invention relates to a power recovery circuit for impact printers and more particularly for dot matrix impact printers.

2. Description of Prior Art

It is known that in dot matrix impact printers, printing is performed by selectively energizing printing elements, each comprising a magnetic circuit and a winding magnetically coupled to the circuit, for magnetizing or demagnetizing it, by means of to a suitable energization current flowing in the winding.

In order to obtain high printing performances, the windings must be energized and deenergized as fast as possible.

Several arrangements have been proposed to this purpose. U.S. Pat. No. 3,909,681, describes a printing electromagnet driving circuit in which the current flowing in the electromagnet winding is controlled by a first switch upstream of the winding and a second switch located downstream of the winding.

Two diodes, normally reverse biased, provide a recycling path for current flowing in the winding. The recycling path comprises the voltage source used to energize the winding.

When the two switches are closed a current flows in the winding due to the voltage source. When one of the switches is opened, the current may flow in the winding through the closed switch and one of the diodes. When both the switches are opened the current flows in the winding through both diodes and the voltage source which opposes the current flow.

The current quickly decays and the winding is deenergized rapidly by transferring the magnetic energy to the same voltage source which provided the energization.

The circuit is very effective, has a high efficiency but requires the use of two switches, two related control circuits and two diodes. It is, therefore, that each printing element requires its own driving circuit.

Alternative arrangements have been proposed which are shown in U.S. Pat. No. 316.056. In such arrangements a single switch is used to control each winding. Each winding is provided with a current recirculation path, normally reverse biased and comprising a resistor and a zener diode. In this circuit, the magnetic energy of the winding is transferred to and wasted in the resistance of the recirculation path.

Power losses in electronic circuits have severe implications which may be summarized in:

increased size and cost of the power supply.

heating of the equipment and need for efficient heat dissipators such as fans, which imply a further cost and size increase of the equipment.

Therefore the simplification in the driving circuits for the printing elements is achieved with the trade off due to the increased cost of other elements and to a reduced efficiency of the equipment.

The present invention overcomes such disadvantages and provides a power recovery circuit which, when added to a conventional power supply for the electronic equipment, allows the use of very simple driving circuits for the printing elements and to obtain from such circuits both a fast deenergization of the electromagnet windings as well as a substantially complete recovery of the magnetization energy.

SUMMARY OF THE INVENTION

These advantages are obtained by a power recovery circuit comprising a voltage booster for generating a voltage higher than the energization voltage of the windings and for charging a buffer capacitor; a voltage sensor for detecting the higher voltage and for providing an enabling signal when such higher voltage exceeds a predetermined threshold; an oscillator which, when enabled by the enabling signal, provides a periodic control signal; a switch and an inductor series connected between the higher voltage and the energization voltage, the switch being periodically opened and closed by the periodical control signal and a diode, reverse biased and connected between ground and the node common to the switch and to the inductor, so that the higher voltage causes a current flow in the inductor when the switch is closed, and when the switch is open the magnetization energy stored in the inductor is further transferred to the energization voltage source, because of a current flowing in the diode.

The buffer capacitor constitutes a higher and regulated voltage source against which the printing electromagnet windings may quickly discharge and transfer their magnetic energy, thus achieving a fast demagnetization and power recovery.

Since the higher voltage source is also regulated, the behaviour of the printing electromagnets is repetitive in time, and not subject to changes which may lead to bad printing quality, as is known in the industry.

BRIEF DESCRIPTION OF THE DRAWINGS

These and other features of the invention will appear more clearly from the following description and the annexed drawings where.

DESCRIPTION OF THE PREFERRED EMBODIMENT

Figure 1:
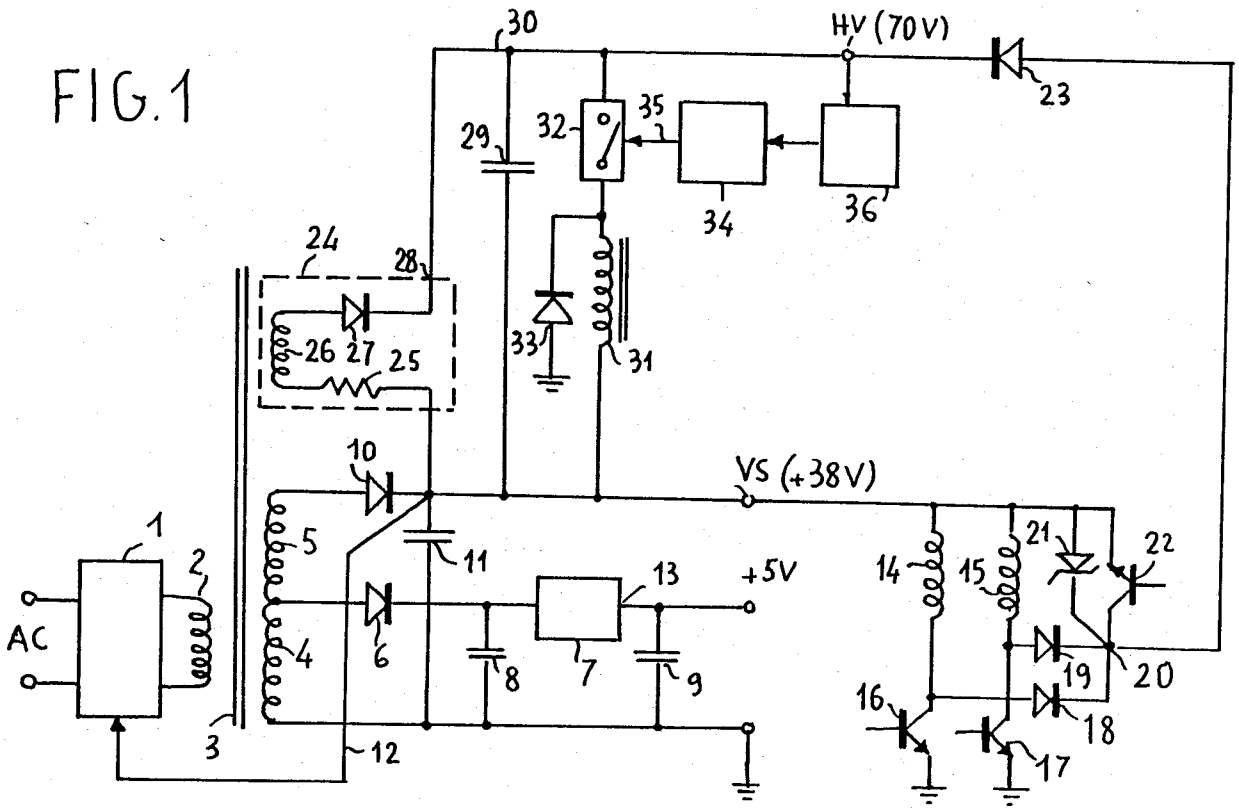
FIG. 1 shows a block diagram of the power recovery circuit of the invention and the circuit environment in which it is located.

A dot matrix impact printer necessarily comprises a power supply and driving circuits for the printing elements.

Generally the power supply comprises a primary control block 1 for converting a main AC voltage (220V,50Hz;125V,50Hz) in a DC voltage which is periodically applied to the primary winding 2 of a transformer 3.

The transformer has two secondary windings 4,5 series connected. One terminal of secondary winding 4 is grounded. The terminal common to windings 4,5 is connected to the anode of a diode 6, whose cathode is connected to the input of a post regulation circuit block 7.

A capacitor 8 is connected between input of block 7 and ground. Block 7 has a voltage output pin 13 providing a regulated output voltage (usually +5V) for powering the logical circuits of the equipment. A capacitor 9 is connected between pin 13 and ground. The other terminal of winding 5, not common to winding 4, is connected to an output terminal VS through a diode 10.

A capacitor 11 is connected between terminal VS and ground. Terminal VS is connected through lead 12 to a control input of primary control block 1, and provides it with a feedback voltage signal, for regulation. The control circuit 1 starts and stops the current flowing in winding 2, generally with a variable "duty cycle" so as to induce current pulses in the secondary windings 4 and 5. Such current pulses charge capacitor 11 at a regulated and predetermined voltage level, which in case of FIG. 1 is assumed to be +38 V. The voltage is used to energize windings 14 and 15 of the printing elements control electromagnets. There are typically 7, 9, 14, or 18 or more printing elements with their respective windings. In FIG. 1 only 2 windings are shown.

One common terminal of the electromagnet windings 14 and 15 is connected to the voltage pin VS. The other terminal of windings 14 and 15 are connected to the collector of transistors 16 and 17 respectively, whose emitters are grounded. The collector of transistors 16 and 17 are further connected to the anodes of diodes 18 and 19 respectively, whose cathode is connected to a common node 20.

In the prior art, node 20 is generally connected to pin VS through a zener diode 21, or a resistor, and through a transistor 22.

By switching transistors 16 and 17 on, an energization current flows in windings 14 and 15 from pin VS to ground. When transistors 16 and 17 are switched off, the energization current circulate from pin VS, through the windings 14 and 15, diodes 18 and 19 and transistor 22 to terminal VS. If transistor 22 is switched off, the current quickly decays, flowing in zener diode 21 and the magnetization energy is dissipated in zener diode 21.

According to the invention, instead of having zener diode 21 as a recirculation path, node 20 is connected, through a diode 23, to the power recovery circuit which will now be described.

The power recovery circuit of the invention comprises a voltage booster 24. In its simplest form, the voltage booster 24 may consist of a current limiting resistor 25, a winding 26 inductively coupled to primary winding 2 and a diode 27, all series connected. The input of voltage booster 24 is connected to pin VS.

A capacitor 29 is connected between the output 28 of the voltage booster 24 and pin VS. Capacitor 29 is charged at a voltage level determined by the voltage booster. Node 30, connected to the output of voltage booster 24, may be brought to a voltage level HV, relative to ground, which may exceed 70 V.

An inductor 31 has a terminal connected to pin VS and the other terminal connected to node 30, through a switch 32.

The inductor 31 terminal connected to switch 32 is further connected to the cathode of a diode 33, whose anode is grounded. Switch 32 is controlled by an oscillator 34 which, when enabled by an enabling signal, produces at the output 35 a periodical control signal which alternatively switches switch 32 on and off. The enabling signal is provided by a voltage detecting circuit 36, which has a sensing input connected to node 30. When the node 30 voltage exceeds a predetermined level, for instance 70 V, an enabling signal is forwarded to oscillator 34. The cathode of the previously mentioned diode 23, is connected to node 30.

The operation of the power recovery circuit is as follows.

When the power supply start operating, the voltage booster 24 charges capacitor 29 and voltage at node 30 rises until it exceeds 70 V. At this point the voltage detecting circuit 36 provides an enabling signal 34 which starts to periodically switch on and off switch 32.

When switch 32 is closed, a current starts flowing in inductor 31 and linearly increases, magnetizing inductor 31 This occurs at the expenditure of energy stored in capacitor 29 so that the voltage level at node 30 decreases.

When switch 32 is opened, a demagnetizating current continues to flow in inductor 31 from ground towards terminal VS, through diode 33 until inductor 31 is completely demagnetized. Thus demagnetization current charges capacitor 11 with power recovery. When voltage at node 30 decreases at a level just below 70 V, oscillator 34 is no larger enabled and switch 32 is kept open until voltage at node 30 rises again and exceeds 70 V.

In conclusion, electric power is drained from the power supply by voltage booster 24 and a corresponding energy is stored in capacitor 29. Then, power is transferred from capacitor 29 to inductor 31 in the form of magnetic power, which is returned to the power supply and stored in capacitor 11.

What may appear an idle and useless power circulation, has the advantage of providing a higher and regulated voltage source (with a small ripple around 70 V) to which the magnetic energy of the printing elements (14 and 15) may be transferred for storing (in capacitor 29) and recovery (in capacitor 11). In fact, it is clear that once the equipment has been powered on and the printer has started the printing operations, most if not all of the charging power for capacitor 29 may be obtained from deenergization of windings 14 and 13 and only a small power fraction or no power is drained from the voltage booster. Therefore a high conversion or recovery efficiency may be achieved.

Figure 2:
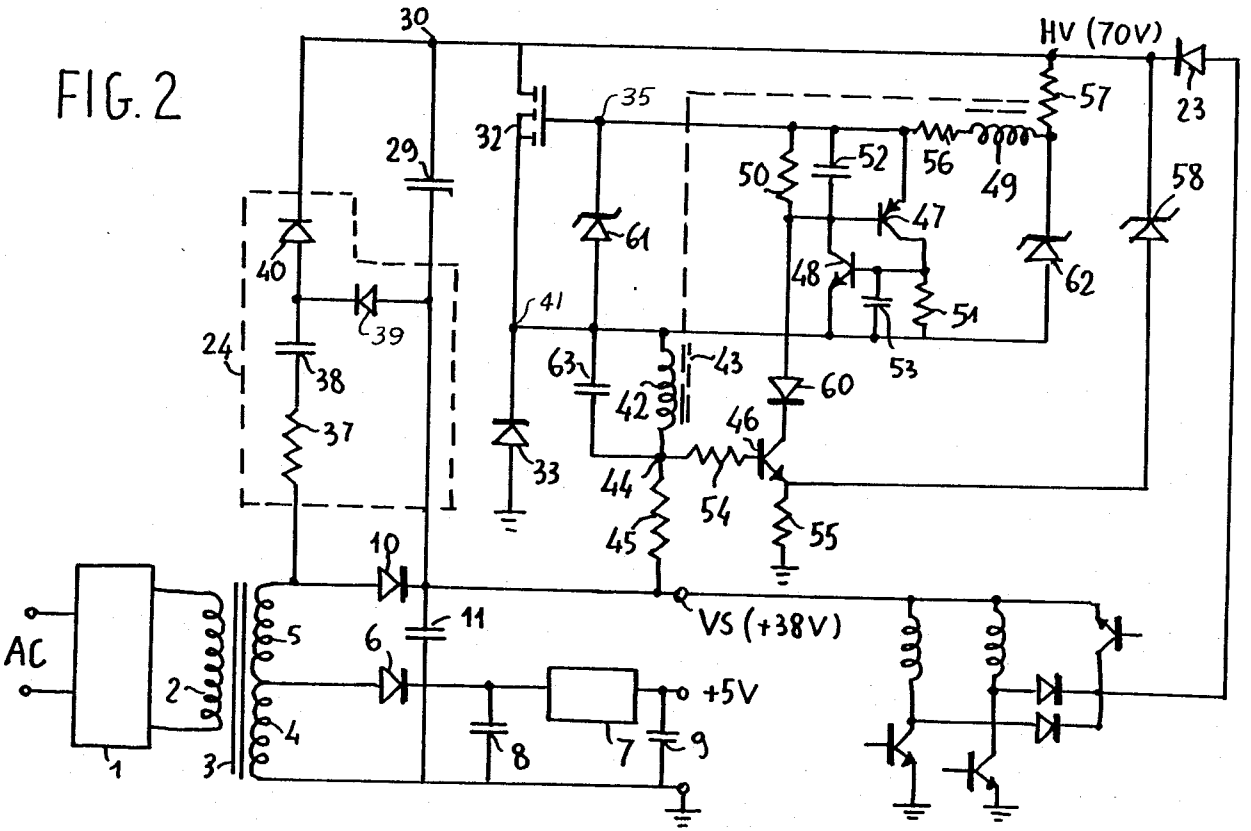
FIG. 2 shows the electric diagram of a preferred form of embodiment of the power recovery circuit of the invention.

FIG. 2 shows a preferred form of embodiment of power recovery circuit which is simple, inexpensive and achieves a high conversion efficiency and further does not need auxiliary external voltage sources for the powering of the control circuit.

In FIG. 2 the power supply is shown only in part and the elements common and functionally equivalent of FIG. 1 and FIG. 2 are identified by the same reference numerals.

The voltage booster comprises a resistor 37, a capacitor 38 and two diodes 39 and 40. Resistor 37, capacitor 38 and diode 40 are series connected between the anode of diode 10 (of the power supply) and node 30, with cathode of diode 40 connected to node 30. Diode 39 has the anode connected to terminal VS and its cathode connected to capacitor 30 and to the anode of diode 40. Capacitor 38 may have a capacity of 0.1 uF, very small when compared with the capacity of capacitor 11, which may be in the order of thousands of uF.

When control block 1 induces in windings 4 and 5 an electromotive force which reverse biases diode 10, or when no e.m.f. is induced in the windings, capacitor 38 is charged through diode 39 and resistor 37, at a voltage level equal or greater than voltage at pin VS (38 V).

When control block 1 induces in windings 4 and 5 an electromotive force which forward biases diode 10, the anode of diode 10 is brought at the voltage level of pin VS (plus the voltage drop in diode 10) and correspondingly the voltage at the anode of diode 40 increases and forward biases diode 40, while diode 39 is reverse biased.

The charge stored in capacitor 38 is partially discharged in capacitor 29 and in the course of subsequent e.m.f. alternances induced in windings 4 and 5, capacitor 29 tends to charge to the same charge voltage reached by capacitor 38.

Switch 32 consists of a field effect transistor (MOSFET) with N channel, whose drain electrode is connected to node 30 and whose source electrode is connected to a node 41. Diode 33 is connected between ground and node 41 The primary winding 42 of a transformer 43 has a terminal connected to node 41. The other terminal is connected to a node 44, which in turn is connected to terminal VS through a low resistance value resistor 45. A capacitor 63 is connected in parallel to the primary winding.

In FIG. 2 the controlled oscillator comprises a control switch, consisting of a transistor 46, a regenerative switch consisting of two transistors 47 and 48 a secondary winding 49 of transformer 43 and biasing, current limiting resistors and capacitors 50, 51, 52, 53, 54, 55, 56, and 57. The controlled oscillator further comprises a protection diode 60 and two Zener diodes 61 and 62.

The voltage equivalent of detecting circuit 36 in FIG. 1 consists of a zener diode 58.

The output 35 of the controlled oscillator is connected to the gate of the field effect transistor 32 and forms a node 35 to which several elements are connected. Zener diode 61 has the cathode connected to node 35 and the anode connected to node 41. Resistor 57, secondary winding 49, resistor 56, and switch 32 are series connected between node 30 (the high voltage node) and node 35. PNP Type Transistor 47 has its emitter connected to node 35. Resistor 50 and capacitor 52 are connected in parallel between node 35 and the base of transistor 47. The collector of transistor 47 is connected to node 41 through resistor 51 and capacitor 53 in parallel with each other.

NPN type Transistor 48, has its collector connected to the base of transistor 47 and the emitter connected to node 41. The base of transistor 47 and the collector of transistor 48 are further connected to the anode of diode 60, whose cathode is connected to the collector of transistor 46. The base of transistor 46 is connected to node 44 through resistor 54 and the emitter is connected to ground, through resistor 55. The emitter of transistor 46 is further connected to the anode of zener diode 58, whose cathode is connected to node 30. Node 41 is further connected to the anode of zener diode 62 whose cathode is connected to a point common to resistor 57 and secondary winding 49.

The operation of the circuit is as follows:

When the voltage at node 30, relative to the voltage at terminal VS, is below the level established by the zener voltage of diode 58, diode 58 is blocked and the controlled oscillator is idle. When the oscillator is idle, transistor 46 is conducting and base, emitter collector of transistor 46 are at a voltage slightly lower than voltage at terminal VS.

A low intensity current flows in resistor 57, in winding 49, in resistor 56, resistor 50, diode 60 and in the junctions emitter-base, base-collector of transistor 46 as well as in resistor 55. Therefore node 35 is held at a voltage substantially equal to the voltage of node 41, owing to the voltage drop in resistors 56 and 57, and FET 32 is open.

No current flows in winding 42 and the voltage booster 24 progressively raises the voltage level of node 30 by charging capacitor 29. When the voltage at node 30, relative to voltage of terminal VS, exceeds the zener voltage of diode 58, diode 58 starts conducting and a higher current flows in resistor 55 causing a voltage drop which raises the voltage at the emitter of transistor 46 above the base potential (which is substantially the voltage at terminal VS). Transistor 46 , as well as transistor 47 are switched off and the voltage at node 35 rises, relative to voltage at node 41, to a level limited by zener diode 61. FET 32 is now conductive and the controlled oscillator is in the active state.

Once FET 32 is conductive a current begins to flow through FET 32, winding 42 and resistor 45 terminal VS, and increases, substantially linearly In addition an EMF is induced in secondary winding 49 which tends to increase or sustain the voltage at node 35. When the current in winding 42 and resistor 45 reaches a level which causes a voltage drop in resistor 45 sufficient to forward bias the junction base-emitter of transistor 46, it becomes conductive and current is drained through resistor 50. Therefore even transistor 47 is driven to a conductive state and in turn, drives transistor 48 to a conductive state. Therefore node 35 is shorted to node 41 and FET 32 is opened. The current in winding 42 start to decrease and is now drained from ground through diode 33.

As a consequence a reverse EMF is induced in secondary winding 49, which lowers the node 35 voltage to a level slightly lower (voltage drop in diode 61) than the one of node 41 and keeps FET 32 switched off. Transistors 47 and 48 are opened, but a current path is established by diode 61, winding 49, resistor 56 and zener diode 62.

During the demagnetization phase of transformer 43, capacitor 63 is charged at a voltage level equal to the counter electromotive force induced in primary winding 42 and when transformer 43 is completely demagnetized and the current in winding 42 drops to zero, the charge voltage of capacitor 63 launches in the primary an increasing current of reverse direction which tends to reverse the magnetization of transformer 43. Capacitor 63 and transformer 43 act as an oscillating system.

In a first phase of energy transfer from capacitor 63 to transformer 43 the increasing current in primary winding 42 induces in secondary winding 49 an EMF which drops the voltage of node 35 below the voltage at node 41 so that FET 32 is held switched off. When capacitor 63 is discharged, the current continues to flow with the same direction in primary winding 42 and tends to reverse the charge of capacitor 63 with a decreasing intensity. The EMF induced in secondary winding 49 reverses and raises the voltage at node 35 above the voltage at node 41 so that FET 32 is again switched on. Thus current in winding 42 drops to 0, reverses and rapidly increases.

A new magnetization and demagnetization cycle starts, identical to the one already considered. Therefore the controlled oscillator continue to oscillate, with self induced oscillations, as long as it is in the active state, that is as long as the voltage at node 44 controls transistor 46 and renders 20 it conductive. Transistor 46 was following in a nonconductive state.

If the voltage at node 30 drops below the value established by the zener voltage of diode 58, transistor 46 is forced again to a conductive state and the voltage at node 35 is pulled down to keep FET 32 in the off state.

The controlled oscillator then returns in idle state. Although non exclusive and susceptible of several changes the described embodiment is particularly advantageous because it provides self powering of the controlled oscillator, without need of auxiliary power sources, because it offers a very high efficiency, greater that 90% and because it can operate at self oscillation frequencies in the order of 150–250 KHz, which lead to the use of components, namely capacitors and transformer of minimum cost and encumbrance.

What is claimed is:

1. Power recovery circuit for printer having printing elements actuated by electromagnets (14,15) energized by a voltage VS available at a terminal, comprising:

a voltage booster (24) for obtaining from a power supply generating said voltage VS a node at a voltage HV higher than said voltage VS, a buffer capacitor connected between said node at HV voltage and said terminal at voltage VS, said buffer capacitor being charged by said voltage booster, a unidirectional connection (18,19,23) between said electromagnets and said node at voltage HV for converting the magnetic energy imparted to said electromagnets in capacitive energy stored in said buffer capacitor, a control switch (32) and an inductor (31) series connected between said node at voltage HV and said terminal at voltage VS, a recirculation diode (33) connected between ground and a node common to said switch and said inductor, a voltage detector (36) providing an enabling signal when said voltage HV exceeds a predetermined value, and an oscillator (34) controlled by said enabling signal for generating, when enabled by said enabling signal, a periodical control signal which periodically switches on and off said switch 32, said control signal maintaining switched off said switch when said oscillator is disabled.

2. Power recovery circuit as claimed in claim 1 wherein said control switch is a FET having DRAIN connected to said node at voltage HV, SOURCE connected to said inductor and GATE receiving said control signal, and wherein said controlled oscillator comprises:

a capacitor (63) in parallel to said inductor, a secondary winding magnetically coupled to said inductor and having a first control terminal coupled to said GATE, and a second terminal coupled to said source:

a first current measuring resistor (45) connected between said inductor and said terminal at voltage VS, a control transistor (46) for controlling said shorting means, having base connected to the node common to said measuring resistor and said inductor, emitter ground connected through a second resistor and collector connected to said shorting means for their control, and wherein said voltage detector consists in a zener diode connected between said node at voltage HV and the emitter of said control transistor (46), whereby if said HV voltage is lower than a predetermined threshold, said control transistor is conductive and controls said shorting means to short said secondary winding and said GATE SOURCE pair, and if said HV voltage exceeds said predetermined threshold said control transistor 46 is open or closed as a function of the base biasing imparted by the voltage drop in said measuring resistor and periodically controls the shorting of said secondary winding and said GATE-SOURCE pair and consequently the switching off of said FET, the periodical switching on of said FET being determined by the emf induced in said secondary winding by the periodical current changes in said inductor.

3. Power recovery circuit as claimed in claim 1 wherein said oscillator is a fixed frequency oscillator.

4. Power recovery circuit as claimed in claim 3 wherein said oscillator is powered by the voltage existing between said node at voltage HV and said terminal at voltage VS.

* * * * *